United States Patent [19]

Amberntson

[11] 4,123,019

[45] Oct. 31, 1978

[54] METHOD AND SYSTEM FOR GRAVITY COMPENSATION OF GUIDED MISSILES OR PROJECTILES

[75] Inventor: David S. Amberntson, Orlando, Fla.

[73] Assignee: Martin Marietta Corporation, Bethesda, Md.

[21] Appl. No.: 740,740

[22] Filed: Nov. 10, 1976

[51] Int. Cl.[2] ..... G06F 15/50

[52] U.S. Cl. ..... 244/3.2; 73/178R; 244/3.16; 364/435

[58] Field of Search ..... 73/178 R; 74/5.1, 5.49; 102/3; 235/61.5 R, 61.5 E, 150, 25 E, 61.5 G, 61.5 S; 244/3.1–3.2, 14, 175, 190

[56] References Cited

U.S. PATENT DOCUMENTS

| | | | |
|---|---|---|---|
| 3,312,423 | 4/1967 | Welch | 244/3.20 X |
| 3,699,316 | 10/1972 | Lopes, Jr. | 73/178 R X |
| 3,718,293 | 2/1973 | Willems et al. | 244/3.16 |
| 3,829,659 | 8/1974 | Margolis | 235/150.25 X |

OTHER PUBLICATIONS

Russell, W. T., "Inertial Guidance For Rocket--Propelled Missiles," *Jet Propulsion Magazine,* Jan. 1958, pp. 17–24.

*Primary Examiner*—Stephen G. Kunin
*Attorney, Agent, or Firm*—Burns, Doane, Swecker & Mathis

[57] ABSTRACT

A control system for a guided missile or projectile in which signals to compensate the steering commands of the guided missile or projectile for the effects of gravity are dynamically produced and stored while the missile or projectile is in flight. The system includes a gyroscope mounted in the missile or projectile for establishing an attitude reference axis independent of the attitude of the missile or projectile. Gravity compensation signals are generated in response to sensed angular differences between the attitude at the missile or projectile and the reference axis, and the generated gravity compensation signals are stored. The missile or projectile steering commands are then compensated for gravity effects by use of the stored gravity compensation signals during the guidance mode of operation.

17 Claims, 5 Drawing Figures

FIG 1
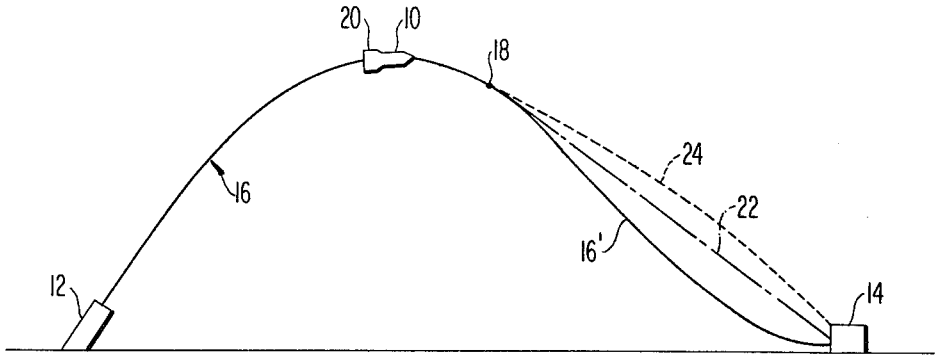
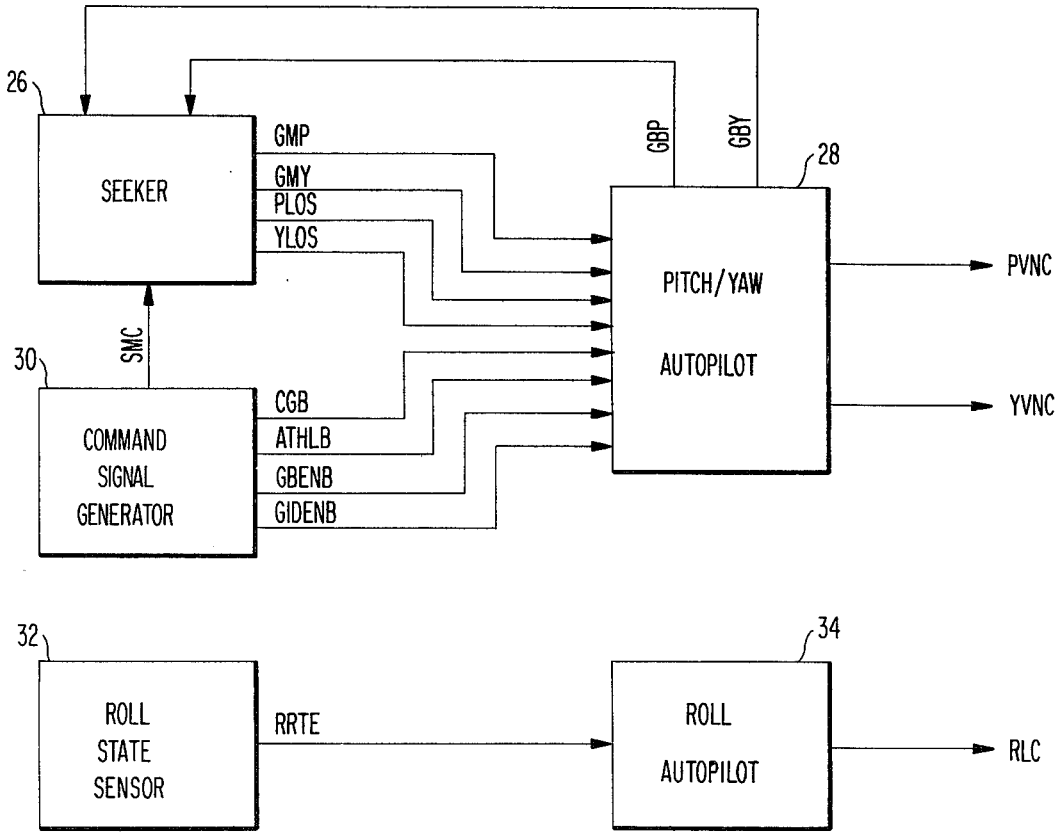
FIG 2

METHOD AND SYSTEM FOR GRAVITY COMPENSATION OF GUIDED MISSILES OR PROJECTILES

BACKGROUND OF THE INVENTION

The present invention relates to the guidance and control of missiles and projectiles and, more particularly, to a method and system for automatically compensating for the effects of gravity on a guided missile or projectile in flight.

The primary effect of gravity on the guidance of missiles or projectiles is modification of the trajectory or flight path downward from that which would be achieved in the absence of gravity. Consequential effects include increased risk of missile or projectile impact on the ground or on near-ground obstructions prior to reaching the intended target, increased requirements on missile or projectile maneuver capability in order to correct the modified trajectory, and degraded accuracy of missile or projectile impact point relative to the intended impact point on the target. These effects are sufficiently severe in many situations as to require incorporation of some means of gravity compensation in the missile or projectile guidance and control system.

Conventional techniques for gravity compensation in guided missiles or projectiles require prelaunch establishment of a known roll attitude reference (e.g., spinup of a gyroscope at a known orientation) and maintenance of that reference throughout launch and flight. The roll attitude of the missile or projectile relative to that reference is then measured by some angular sensor (e.g., a gimbal potentiometer) and the measured roll angle signal is employed either to resolve a fixed gravity bias signal into appropriate gravity compensation signals in a rolling missile or projectile, or to cause control of the missile or projectile to a particular roll attitude for which fixed gravity compensation is provided. Disadvantages of these conventional techniques include the requirement for prelaunch establishment of a known roll attitude reference (inconvenient in many cases), the requirement for maintenance of that reference throughout launch and flight (difficult or impossible for cannon launch), and the lack of means for adjusting the magnitude of the gravity compensation to meet the varied needs of different trajectories.

Another known technique for gravity compensation in guided projectiles includes means for establishing a roll attitude reference after launch by use of a pitch/yaw attitude gyroscope. A roll attitude signal is derived from the pitch/yaw attitude outputs of the gyroscope and is used to control the projectile to a particular roll attitude for which fixed gravity compensation is provided. Disadvantages of this technique include potential instability resulting from pitch/yaw/roll coupling, long roll loop settling times, and the lack of means for adjusting the magnitude of the gravity compensation to meet the varied needs of different trajectories.

It is accordingly an object of the present invention to provide a novel method and system for gravity compensation in a guided projectile or missile system in which the roll attitude of the projectile or missile need not be determined.

It is another object of the present invention to provide a novel method and system for producing a gravity compensation signal for a missile or projectile while in flight and without regard to the roll attitude at which the missile or projectile is stabilized.

It is yet another object of the present invention to provide a novel method and system for compensation of gravity in a projectile or missile guidance system in which the magnitude of gravity compensation is automatically adjusted to meet the needs of a desired trajectory.

It is still another object of the present invention to provide a novel method and system for gravity compensation in a missile or projectile guidance system wherein improved accuracy, shorter roll settling time, elimination of pitch/yaw/roll coupling instability problems and increased tolerance of guidance system parameter deviations are achieved.

It is a further object of the present invention to provide a novel method and system for producing gravity compensation signals for an in flight guided projectile or missile in which the missile or projectile is roll stabilized at an arbitrary roll attitude and pitch and yaw steering command correction signals for gravity compensation are automatically calculated at the arbitrary roll attitude in response to sensed differences between an attitude reference axis established in the missile or projectile and the attitude of the missile or projectile.

These and other objects and advantages of the present invention are accomplished in accordance with the present invention as will become apparent to one skilled in the art to which the invention pertains from a perusal of the following detailed description when read in conjunction with the appended drawings.

BRIEF DESCRIPTION OF THE DRAWINGS

FIG. 1 is a pictorial representation of the flight path of a missile or projectile as it is guided from a launching point to a target by a typical guidance system;

FIG. 2 is a functional block diagram of one form of guidance and control system for a missile or projectile such as that illustrated in FIG. 1;

DETAILED DESCRIPTION

Figure 3:
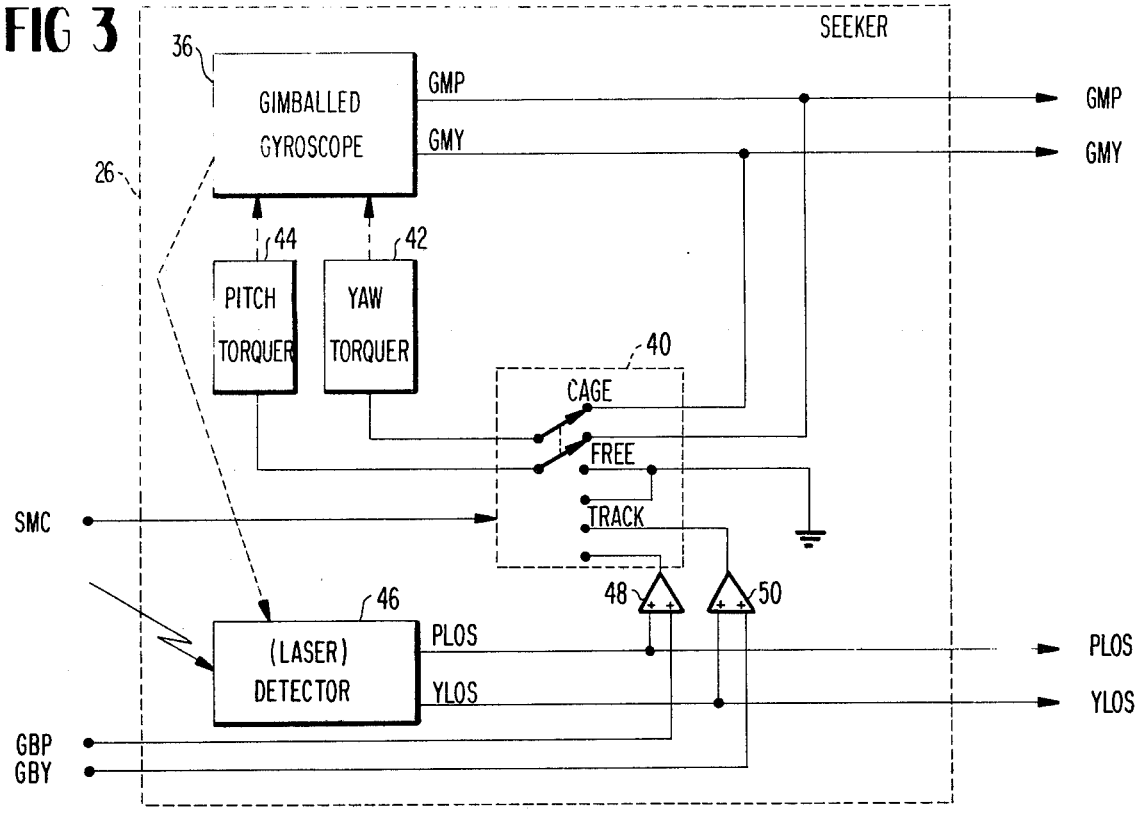
FIG. 3 is a functional block diagram illustrating one form of the seeker of FIG. 2 in greater detail.

FIG. 1 illustrates an exemplary flight path for a guided missile or projectile. The missile or projectile 10 is launched from a launcher 12 in the general direction of a target 14. In the FIG. 1 illustration, the missile or projectile 10 generally follows a flight path indicated, by way of example, at 16, with the initial portion of the flight path 16 to a point 18 being essentially a ballistic path and with the latter portion of the flight path 16 between the point 18 and the target 14 being a guided flight path.

To facilitate an understanding of the invention, the invention will be described hereinafter as implemented in connection with one known system referred to as the cannon launched guided projectile (CLGP) system. In the CLGP system, the launcher 12 is a 155 mm cannon from which the projectile is propelled with conventional artillery charges. Because of the lack of onboard propulsion in the CLGP system, the device propelled from the cannon is typically referred to as a projectile rather than a missile. However, it should be understood that the invention is applicable to other types of guided projectile or missile systems and the invention is not intended to be limited to this one specific implementation.

With continued reference to FIG. 1 and assuming that the flight path 16 is exemplary of the path followed by a cannon launched guided projectile, the projectile 10 is fired from the cannon 12 and at some time after firing a plurality of control vanes or fins 20 are deployed to project outwardly from the tail section of the projectile. The projectile follows a generally ballistic flight path to point 18, at which point the target 14 is acquired and guidance commands are generated and fed to the control vanes 20. Thereafter, the vanes modify the flight path in response to the guidance commands and the projectile is guided along a flight path 16' to the target 14.

As is illustrated by the solid line 16', the flight path of the projectile 10 during the guidance phase will tend to droop below a line-of-sight (LOS) flight path 22 due to the effects of gravity on the projectile. It can be seen that the projectile may therefore strike the ground or an object near the ground prior to reaching the target 14. To prevent this occurrence, the ideal flight path would be along the LOS 22 or preferably even above the LOS 22 as is generally indicated at 24.

To achieve the more ideal flight path 24, it is possible to introduce a fixed gravity bias signal into the guidance signal calculations once the "up" direction of the missile is known. However, as was previously mentioned, there are certain disadvantages to gravity compensation in this manner. In accordance with the present invention, the projectile 10 is roll stabilized to any arbitrary roll angle. Gravity compensation signals are then dynamically calculated at that arbitrary roll angle without the need to determine the roll attitude of the missile or projectile.

One embodiment of a system employing the gravity compensation circuit of the present invention is illustrated in FIG. 2. Referring now to FIG. 2, the guidance system includes a seeker 26 of any conventional type. In the illustrated embodiment of FIG. 2, the seeker 26 is preferably of the type employed in a proportional navigation guidance system. In such a system, the seeker 26 includes a gyroscope that establishes an attitude reference axis (e.g., the gyroscope axis) independent of the projectile attitude, and that produces attitude signals GMP and GMY representing the gyroscope gimbal angles in the respective pitch and yaw directions. These attitude signals indicate projectile attitude relative to the gyroscope axis and are provided to a pitch/yaw autopilot 28. In addition, the seeker 26 provides pitch and yaw line-of-sight signals PLOS and YLOS, respectively, to the pitch/yaw autopilot 28.

As will be described hereinafter in greater detail, the pitch/yaw autopilot 28 generates respective pitch and yaw gravity bias signals GBP and GBY and supplies the signals to the seeker 26. In addition, the pitch/yaw autopilot 28 generates the pitch and yaw vane command signals PVNC and YVNC to control the attitude of the projectile and thus its flight path. As will be seen hereinafter, these vane command signals are produced in response to the attitude signals, the calculated gravity bias signals, the line-of-sight signals, and mode control signals from a command signal generator 30.

The command signal generator 30 generates one or more mode control signals SMC to control the mode of operation (e.g., caged, free, tracking) of the gyroscope in the seeker 26. In addition, the command signal generator 30 supplies a calculate gravity bias signal CGB, an attitude hold signal ATHLD, a gravity bias enable signal GBENB and a guidance enable signal GIDENB to the pitch/yaw autopilot 28 to control the generation of the gravity bias and vane command signals as will hereinafter be described in greater detail.

As was previously mentioned, the system according to the present invention does not require knowledge of the roll attitude of the projectile. Rather, the projectile is roll stabilized at any arbitrary roll attitude prior to and during calculation of the gravity bias signals. In this connection, a suitable conventional roll rate sensor 32 provides a roll rate signal RRTE to a conventional roll autopilot 34. The roll autopilot generates a roll control signal RLC which is then utilized to stabilize the projectile at some arbitrary roll attitude in any suitable conventional manner.

The gyroscope in the seeker 26 is initially caged mechanically when the projectile is first launched. At some preselected point in the flight path, the roll autopilot 34 stabilizes the roll attitude of the projectile at some arbitrary roll angle and the seeker gyroscope is spun up and released from its mechanically caged mode. The gravity compensation calculation may then commence.

In this regard, the gyroscope in the seeker 26 establishes an attitude reference axis independent of the attitude of the projectile. The command signal generator 30 controls the caging and uncaging of the gyroscope so as to select a particular form of gravity bias calculation and to enable the gyroscope to perform properly in the track mode. For example, in accordance with one form of the invention, the gyroscope remains electrically caged during the gravity bias calculation in the sense that the gyroscope is torqued so as to keep the gyroscope, and thus the attitude reference axis, in a predetermined relationship with the attitude of the missile or projectile, e.g., to keep the gyroscope axis aligned with the axis of the projectile. In yet another form of the invention disclosed hereinafter, the gyroscope is placed in an uncaged position during the gravity bias calculation so that it maintains a fixed attitude reference.

The seeker 26 supplies the line-of-sight and attitude reference signals to the pitch/yaw autopilot 28 which, under the control of the command signal generator 30, generates the gravity bias signals in the pitch and yaw directions. As will be seen hereinafter, autopilot 28 utilizes the gravity bias signals in conjunction with the line-of-sight signals generated by the seeker 26 to guide the projectile to the target along a flight path which is compensated for gravity.

FIG. 3 illustrates one embodiment of a typical seeker with which the present invention may be utilized. Referring now to FIG. 3, the seeker 26 includes a gimballed gyroscope 36 of conventional design. The gyroscope 36 provides gimbal angle signals GMP and GMY in the respective pitch and yaw directions from potentiometers or other suitable position transducers coupled to the gyroscope gimbals. The gimbal angle signals GMP and GMY are supplied to the CAGE contacts of a gyro torquer control switch 40. The common contacts of the switch 40 are connected to respective yaw and pitch torquers 42 and 44 which in turn apply torques to the gyroscope 36 so as to control its position in a conventional manner.

The seeker 26 also includes a detector 46 for establishing a line-of-sight from the missile or projectile to the target. For example, a suitable laser detector optically coupled to the gyroscope 36 may be provided to detect laser energy reflected from the target. The detector may be of a well known type that provides error signals related to the angular difference between the target line-of-sight and the seeker reference axis. The detector 46 provides the respective pitch and yaw line-of-sight signals PLOS and YLOS both to the pitch/yaw autopilot 28 of FIG. 2 and to one input terminal of respective summing amplifiers 48 and 50. The gravity bias signals GBP and GBY in the respective pitch and yaw directions are supplied to the other input terminals of the respective amplifiers 48 and 50, and the output signals from the summing amplifiers 48 and 50 are supplied to a set of TRACK contacts of the switch 40 as illustrated.

The switch 40 also includes a set of free contacts which are either open or connected to ground as illustrated and the switch 40 is controlled by the mode control signals SMC supplied from the command signal generator 30. Depending on how the gravity bias signal is to be calculated, the mode control signal SMC may either maintain the switch 40 in the CAGE position or place it in the FREE position during the gravity bias calculation.

The TRACK position of the switch 40 is not assumed until the seeker is actually placed in track mode after the gravity bias signal has been calculated. In this connection, the laser detector 46 detects energy reflected from the target and generates the pitch and yaw line-of-sight signals PLOS and YLOS, respectively. In track mode, these signals are summed with the gravity bias signals in the respective pitch and yaw directions by the amplifiers 48 and 50. The sum signals are supplied to the pitch and yaw torquers to control the positioning of the gyroscope 36 and, thus, the optical member (e.g., a mirror) controlled by the gyroscope 36. The line-of-sight signals PLOS and YLOS are additionally supplied to the pitch/yaw autopilot 28 for use in generating the vane command signals as will subsequently be described in greater detail.

Figure 4:
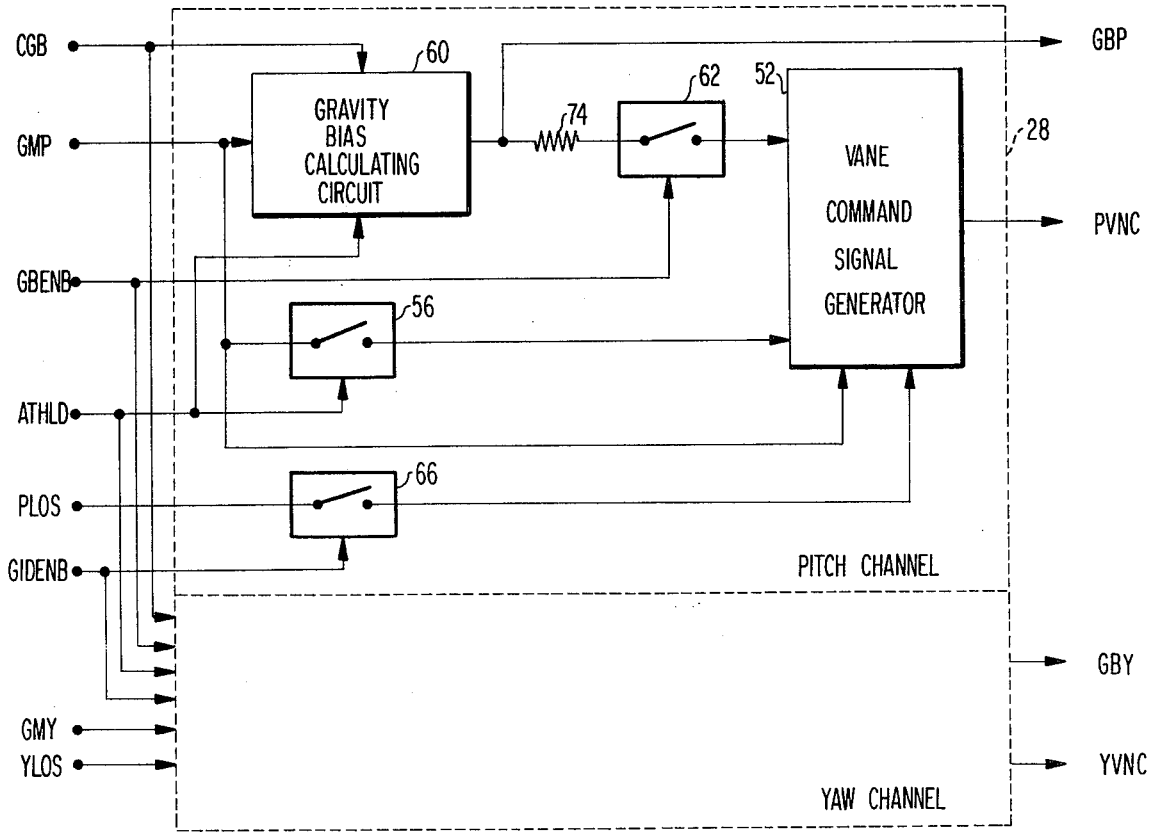
FIG. 4 is a functional block diagram illustrating one embodiment of the pitch/yaw autopilot of FIG. 2, including the gravity compensation circuit, in greater detail.
Figure 5:
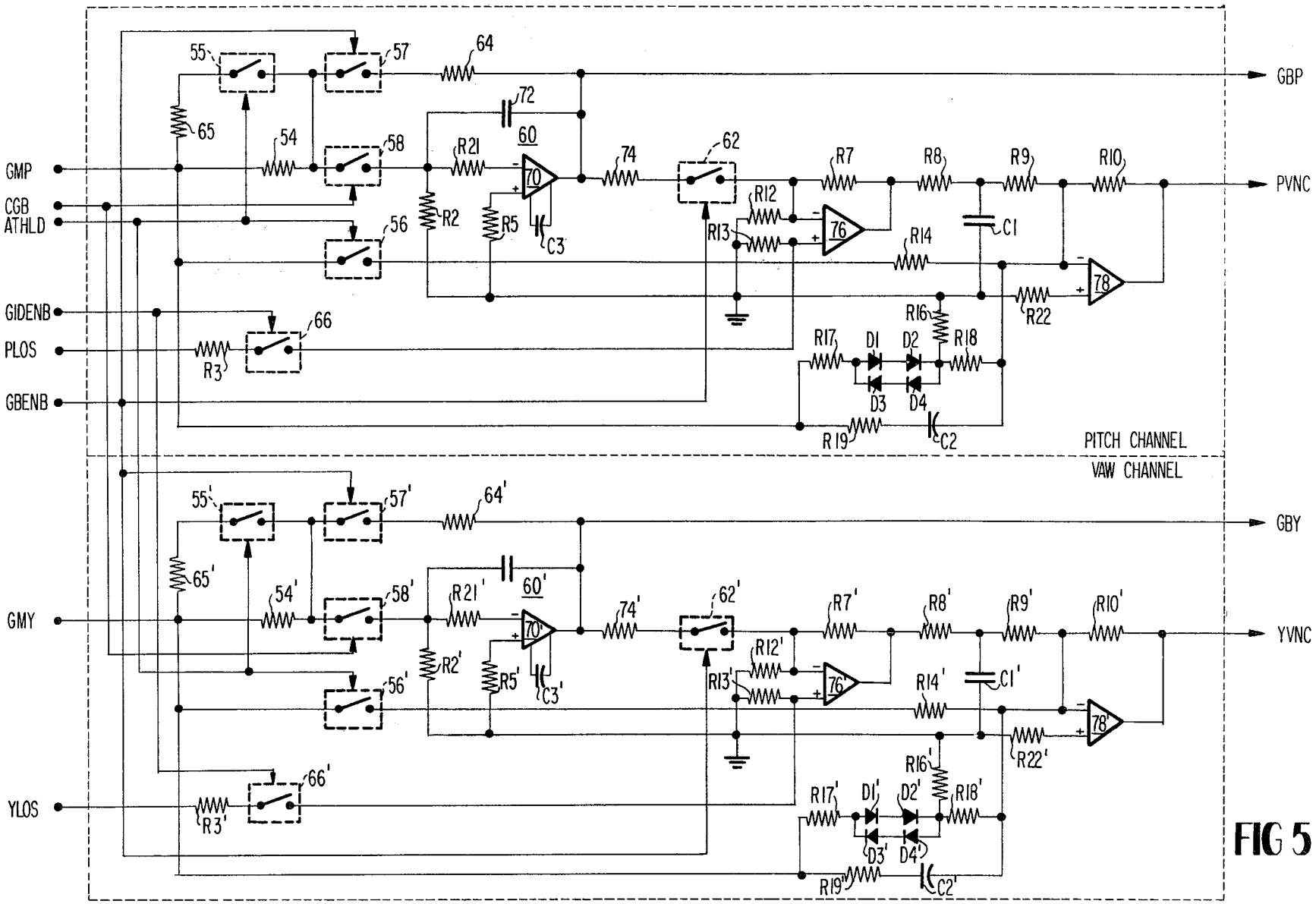
FIG. 5 is a circuit diagram schematically illustrating the autopilot and gravity compensation circuit of FIG. 4 in greater detail.

FIGS. 4 and 5 illustrate a preferred embodiment of the pitch/yaw autopilot 28 of FIG. 2 in greater detail. It should be noted that the circuits used to process the line-of-sight signals in the pitch and yaw directions as well as to generate the gravity bias signals in these directions are identical for both the pitch and yaw channels. Accordingly, only the pitch channel of the pitch/yaw autopilot is illustrated in detail in FIGS. 4 and 5.

Referring now to FIG. 4, the pitch gimbal angle GMP from the gyroscope 36 of FIG. 3 is supplied to a vane command signal generator 52 directly and through a switch 56. The attitude hold signal ATHLD from the command signal generator 30 of FIG. 2 controls the operation of the switch 56 and together with the calculate gravity bias signal CGB from the command signal generator 30 of FIG. 2 controls the operation of a gravity bias calculating circuit 60. It should be noted that while the switch 56 and other switches in the autopilot 28 are functionally illustrated as mechanical switches, these switches are preferably electronic switches controllable in a conventional manner by the control signals from the command signal generator 30. For example, the switch 56 and the other illustrated switches in the autopilot may be field effect transistors (FET's) in which the control signals are applied to the gate electrodes thereof to control the FET's between conductive and non-conductive states.

The output signal from the calculating circuit 60 is supplied to the seeker 26 of FIGS. 2 and 3 as the pitch gravity bias signal GBP. The output signal from the calculating circuit 60 is also applied through a resistor 74 and a switch 62 to the vane command signal generator 52. The operation of the switch 62 is controlled by the gravity bias enable signal GBENB from the command signal generator 30 of FIG. 2. The pitch vane command signal generator 52 generates the pitch vane command signal PVNC which controls the flight path of the projectile through movement of vanes or in any other suitable conventional manner.

The pitch line-of-sight signal PLOS from the detector 46 of FIG. 3 is supplied through a switch 66 to the pitch vane command signal generator 52. The switch 66 is controlled by the guidance enable signal GIDENB from the command signal generator 30 of FIG. 2.

A more detailed, schematic diagram of the pitch/yaw autopilot 28 of FIG. 4 is illustrated in FIG. 5 to facilitate an understanding of the operation of the autopilot. As was previously mentioned, the pitch and yaw signal processing channels of the autopilot may be identical as illustrated. Accordingly, only the specific structure and operation of the pitch channel will be described hereinafter. For clarity, like components in the two channels have been designated by the same numerals with the yaw channel components having the additional "prime" (′) designation.

Referring to FIG. 5, the pitch gimbal angle signal GMP is supplied through a resistor 65 to a switch 55 which is controlled by the attitude hold command signal ATHLD. The output signal of the switch 55 is applied to a switch 58 controlled by the calculate gravity bias signal CGB. The gimbal angle signal GMP is also supplied through a resistor 54 to the switch 58. Components 54, 55, and 65 comprise a gain selection network, providing for independent selection of gains for two modes of gravity compensation calculation as will be further discussed hereinafter.

With continued reference to FIG. 5 and, in particular, the pitch signal processing channel, the output signal from the switch 58 is applied to a gravity bias integrator circuit generally indicated at 60. The integrator circuit 60 is a conventional integrating circuit comprising an operational amplifier 70 and associated components including resistors R2, R5 and R21 and capacitor C3 and 72, arranged in a conventional manner to integrate the applied signal when switch 58 is closed and to hold or store the result when switch 58 is subsequently opened.

The output signal produced by the gravity bias integrator circuit is the gravity bias output signal GBP. A feedback path for control of low frequency gain in one mode of gravity bias calculation is provided for coupling the signal GBP through resistor 64 and switch 57 to switch 58. Switch 57 is controlled by the gravity bias enable signal GBENB. The gravity bias signal GBP, through resistor 74 and switch 62, is applied to the vane command signal generator 52 together with the attitude hold gated GMP signal from the switch 56, the guidance signal from switch 66 and the GMP signal from the seeker 26. The vane command signal generator 52 comprises suitable conventional operational amplifiers 76 and 78 arranged in a conventional manner to combine the input signals so as to produce the desired vane command signals.

In the illustrated embodiment of the invention as shown in FIG. 5, the following component values may be used for appropriate signal processing for the cannon launched guided projectile (CLGP):

| Component | Value | Component | Value/Type | |
|---|---|---|---|---|
| R2 | 100K | 74(R) | 422K | |
| R3 | 47.6K | 55(SW) | DG201 | Harris Semiconductor (equivalent acceptable) |
| R5 | 110K | 56(SW) | DG201 | |
| R7 | 422K | 57(SW) | DG201 | |
| R8 | 402K | 58(SW) | DG201 | |
| R9 | 402K | 62(SW) | DG201 | |
| R10 | 402K | 66(SW) | DG201 | |
| R12 | 59K | C1 | 1μf | |
| R13 | 51.1K | C2 | 0.2μf | |
| R14 | 402K | C3 | 33pf | |
| R16 | 1K | 72(C) | 1μf | |
| R17 | 6.81K | D1 | 1N4148 | |
| R18 | 200K | D2 | 1N4148 | |
| R19 | 51.1K | D3 | 1N4148 | |
| R21 | 10K | D4 | 1N4148 | |
| R22 | 90.9K | 70 | LM101A | National Semiconductor (equivalent acceptable) |
| 54(R) | 511K | 76 | LM747 | |
| 64(R) | 200K | 78 | LM747 | |
| | | 65(R) | 35.7K | |

C = capacitor
D = diode
K = kilohms
R = resistor
SW = switch

In this exemplary application, the gravity compensation circuit functions as follows: At an appropriate time after launch of the projectile, the calculate gravity bias signal CGB closes the switch 58 and the gimbal angle signal GMP is applied to the gravity bias calculating circuit 60. During the calculation of the gravity bias signal, switch 66 remains in the open position.

If the gravity bias signal is to be calculated in the attitude hold mode, switches 55 and 57 are open, switches 56 and 62 are closed, and the projectile is controlled by the vane command signals PVNC and YVNC so as to maintain its attitude in a predetermined relationship with the attitude reference axis of the gyroscope 36 (e.g., in alignment with the attitude reference axis). In the attitude hold mode of gravity bias calculation, the switch 40 in the seeker 26 of FIG. 3 is placed in the FREE position so that the gyroscope is totally uncaged and maintains a fixed attitude reference axis. Any angular differences between the gyroscope attitude reference axis and the attitude of the projectile are then reduced by modifying the attitude of the projectile. The gravity bias signal GBP increases until the gimbal angle signal GMP is reduced to zero, at which time signal GBP is providing the vane command needed to compensate gravity effects in pitch.

The gravity bias signal may alternatively be calculated in a ballistic flight mode with the gyroscope in an electrically caged condition so that any angular differences between the gyroscope attitude reference axis and the attitude of the projectile are reduced by torquing the gyroscope. In this mode of calculating the gravity bias signal, switches 56, 62 and 66 are open, switches 55, 57 and 58 are closed, and switch 40 is in the CAGE position. As the projectile flight path and attitude rotate downward under the influence of gravity, the reference axis of the electrically caged seeker 26 tends to lag behind (i.e., above) the projectile centerline. The resulting pitch gimbal angle signal GMP will be proportional to the pitch axis component of the gravity-induced rotational rate. The gravity bias calculation circuit 60 produces a pitch gravity bias signal GBP proportional to the gimbal angle signal GMP and therefore proportional to the pitch component of gravitational influence. Resistor 65 is selected to obtain the proper ratio of gravity bias to rotational rate.

As mentioned previously, the above discussion of pitch channel operation applies equally to an identical yaw channel, so that both pitch and yaw gravity compensation signals (i.e., the gravity compensation signal yaw and pitch components) are generated. Also, the calculation of the gravity compensation signals GBP and GBY is a dynamic closed-loop function, so that adjustment of these signals as appropriate to varying conditions (e.g., roll attitude, dive angel, velocity) is automatic.

The present invention may be embodied in other specific forms without departing from the spirit or essential characteristics thereof. The presently disclosed exemplary embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A system for producing a signal to compensate the flight path of a guided missile or projectile for the effects of gravity comprising:

means mounted in the missile or projectile for establishing an attitude reference axis independent of the attitude of the missile or projectile;

means for sensing an angular difference between the attitude of the missile or projectile and the attitude reference axis;

means for generating a gravity compensation signal in response to the sensed angular differences between the attitude of the missile or projectile and the reference axis;

means for storing said generated gravity compensation signal; and means for compensating the flight path of the missile or projectile in response to the stored gravity compensation signal.

2. The system of claim 1 wherein said gravity compensation signal generating means comprising:

means for generating an electrical signal related to said sensed difference; and means for modifying the angular difference between the attitude of the missile or projectile and the reference axis in response to said electrical signal.

3. The system of claim 2 wherein said attitude reference axis establishing means comprises a gyroscope mounted within the missile or projectile, and wherein said modifying means comprises means for torquing said gyroscope in response to said electrical signal to align the reference axis with the attitude of the missile or projectile.

4. The system of claim 1 wherein said attitude reference axis establishing means comprises a gyroscope mounted within the missile or projectile, and wherein said gravity compensation signal generating means comprises:

means for caging said gyroscope to maintain the attitude reference axis in a fixed relationship with the attitude of the missile or projectile;

means for releasing said gyroscope from the caged condition at a predetermined time during the flight of the missile or projectile;

means responsive to a sensed angular difference between the attitude of the missile or projectile and the attitude reference axis for generating an electrical signal related to the sensed difference; and means responsive to said electrical signal for torquing the gyroscope to align the attitude reference axis with the attitude of the missile or projectile.

5. The system of claim 1 wherein said fixed attitude reference axis establishing means comprises a gyroscope having a reference axis mounted within the missile or projectile and wherein said gravity compensation signal generating means comprises:

means for maintaining the gyroscope reference axis in a fixed relationship with the attitude of the missile or projectile during an initial launch period of the missile or projectile;

means for releasing the gyroscope from the maintained fixed relationship during flight of the missile or projectile; and said gravity compensation signal being generated in response to the angular difference between the attitude reference axis and the attitude of the missile or projectile sensed by said sensing means subsequent to release of the gyroscope.

6. The system of claim 5 further including means responsive to the sensed difference for torquing the gyroscope to align the attitude reference axis with the attitude of the missile or projectile.

7. The system of claim 6 further including means for generating an electrical signal in response to said sensed difference and means for integrating said generated electrical signal to provide said gravity compensation signal.

8. The system of claim 5 further including means responsive to the sensed difference for modifying the flight path of the missile or projectile to align the attitude of the missile or projectile with the attitude reference axis.

9. The system of claim 7 further including means for generating an electrical signal in response to said sensed difference and means for integrating said generated electrical signal to provide said gravity compensation signal.

10. A system for producing a signal to compensate the flight path of a guided missile or projectile for the effects of gravity comprising:

means mounted in the missile or projectile for establishing an attitude reference axis independent of the attitude of the missile or projectile;

means for sensing a gravity induced change in missile attitude with respect to said reference axis and for generating a signal related to said sensed change; and means for storing said generated signal for subsequent modification of the flight path of the missile or projectile.

11. A system for guiding a missile or projectile over a flight path from a launching point to a target comprising:

means mounted in the missile or projectile for establishing a reference axis independent of the missile or projectile attitude;

means for sensing an angular difference between said reference axis and the line-of-sight to the target;

means for generating and storing a gravity compensation signal related to gravity induced changes in the attitude of the missile or projectile while in flight;

means for stabilizing the missile or projectile at an arbitrary roll attitude;

means for enabling said generating and storing means to generate and store said gravity compensation signal subsequent to stabilization of roll attitude by said stabilizing means;

means for modifying the flight path of the missile or projectile in response to said sensed angular difference and said stored gravity compensation signal.

12. A method for dynamically producing a gravity compensation signal for compensating the flight path of a missile or projectile comprising the steps of:

establishing, within the missile or projectile, an attitude reference independent of the attitude of the missile or projectile;

sensing changes in the attitude of the missile or projectile relative to the attitude reference;

generating a gravity bias signal in response to the sensed changes in the attitude of the missile or projectile relative to the attitude reference; and, storing the gravity bias signal for subsequent modification of the flight path of the missile or projectile.

13. A method of calculating a gravity compensation signal for a missile or projectile while the missile or projectile is in flight, comprising the steps of:

establishing a fixed attitude reference axis independent of the attitude of the missile or projectile;

modifying the attitude of the missile or projectile to align the missile or projectile in attitude with the established reference axis;

generating, as a gravity compensation signal, a signal related to the attitude modification required to effect the alignment of the missile or projectile attitude with the reference axis; and storing the generated gravity compensation signal.

14. A method for calculating a gravity compensation signal for compensating the flight path of a missile or projectile while in flight comprising the steps of:

(a) establishing a missile attitude axis having a known, fixed relationship to the flight path of the missile or projectile;

(b) stabilizing the missile or projectile in roll attitude;

(c) establishing, with a gyroscope mounted in the missile or projectile, an attitude reference axis independent of the attitude axis of the missile or projectile;

(d) applying signals to torque the gyroscope and align the reference axis with the attitude axis of the missile or projectile; and, (e) storing said signals as a gravity compensation signal.

15. A method for producing a signal to compensate the flight path of a missile or projectile for the effects of gravity comprising the steps of:

establishing, in the missile or projectile, an attitude reference axis independent of the attitude of the missile or projectile;

sensing a gravity induced change in missile attitude with respect to the reference axis during the flight of the missile or projectile; and generating, as a gravity bias signal, a signal related to the sensed change in missile attitude with respect to the reference axis.

16. The method of claim 15 including the step of stabilizing the roll attitude of the missile or projectile at any arbitrarily selected roll angle prior to the steps of sensing and generating.

17. A method of compensating the flight path of a guided missile or projectile for the effects of gravity comprising the steps of:

stabilizing the missile or projectile in roll attitude after launch and prior to initiation of guidance of the missile or projectile;

establishing, within the missile or projectile, an attitude reference axis independent of the attitude of the missile or projectile subsequent to stabilizing the roll attitude;

sensing gravity induced changes in missile or projectile attitude relative to the established reference axis;

generating a signal related to the sensed gravity induced changes in missile or projectile attitude relative to the established reference axis;

storing the generated signal; and, employing the stored signal as a gravity bias signal during guidance of the missile projectile in order to compensate the missile flight path for the effects of gravity during guidance.

* * * * *